US007377985B2

(12) United States Patent
Zhang et al.

(10) Patent No.: US 7,377,985 B2
(45) Date of Patent: May 27, 2008

(54) TEMPER PROCESS OF SINTERED ND-FE-B PERMANENT MAGNET

(75) Inventors: Min Zhang, Taiyuan (CN); Fengrui Zhang, Taiyuan (CN); Zhendong Kang, Taiyuan (CN); Sanwen Qi, Taiyuan (CN)

(73) Assignee: Shanxi Huiqiang Magnetic Material Manufacturing Co., Ltd., Shanxi (CN)

( * ) Notice: Subject to any disclaimer, the term of this patent is extended or adjusted under 35 U.S.C. 154(b) by 242 days.

(21) Appl. No.: 11/298,967

(22) Filed: Dec. 9, 2005

(65) Prior Publication Data

US 2006/0086428 A1 Apr. 27, 2006

Related U.S. Application Data

(63) Continuation-in-part of application No. PCT/CN2005/000380, filed on Mar. 25, 2005.

(30) Foreign Application Priority Data

Apr. 29, 2004 (CN) ..... 2004 1 0012267

(51) Int. Cl.
*H01F 1/057* (2006.01)

(52) U.S. Cl. ..... 148/101; 148/102; 148/121

(58) Field of Classification Search ..... None
See application file for complete search history.

(56) References Cited

U.S. PATENT DOCUMENTS

| | | | | |
|---|---|---|---|---|
| 4,144,105 | A * | 3/1979 | Gaiffi et al. | 148/103 |
| 4,814,139 | A | 3/1989 | Tokunaga et al. | |
| 5,041,172 | A | 8/1991 | Tokunaga et al. | |
| 5,288,454 | A * | 2/1994 | Lang et al. | 419/38 |
| 5,472,525 | A * | 12/1995 | Tokunaga et al. | 148/302 |
| 2002/0144754 | A1 * | 10/2002 | Tokoro et al. | 148/302 |

FOREIGN PATENT DOCUMENTS

| | | |
|---|---|---|
| CN | 1411007 | 4/2003 |
| JP | 61-119006 | 6/1986 |
| JP | 62-165305 | 7/1987 |

* cited by examiner

*Primary Examiner*—John P. Sheehan
(74) *Attorney, Agent, or Firm*—Connolly Bove Lodge & Hutz LLP

(57) ABSTRACT

The present invention provides a tempering process for sintered Nd—Fe—B permanent magnet material, which optimizes the microstructure of the Nd—Fe—B magnet and improves intrinsic coercive force and its consistency by increasing the cooling rate after tempering. After heating to a temper temperature, the magnetic material is cooled in a cooling liquid within a cooling chamber into which a pressurized cooling gas is introduced.

14 Claims, No Drawings

TEMPER PROCESS OF SINTERED ND-FE-B PERMANENT MAGNET

TECHNOLOGY FIELD

This invention relates to the temper method of sintered Nd—Fe—B permanent-magnet material.

BACKGROUND TECHNOLOGY

The Nd—Fe—B magnetic material is named as "Magnet King" because of its high magnetic energy and coercive force. It is used widely in fields such as electronics, computers, vehicles, machinery, energy and medical equipment. According to 1997 worldwide production statistics, 10,450 tons of Nd—Fe—B series permanent-magnet material was produced, including 8,550 tons of sintered Nd—Fe—B series magnet and 1,900 tons of bonded Nd—Fe—B series magnet. The sintered Nd—Fe—B series magnet has played an important role in the fields mentioned above. The book *Ultra-strong Permanent Magnet* by Zhou Shouzeng (Metallurgy Industry Press, 2004) introduced the following production process flow of sintering Nd—Fe—B series permanent-magnet material: Raw Material Preparation—Smelting—Casting—Crushing and Powdering—Magnetic Field Orientation, Molding—Sintering+Tempering+Machining, and Surfacing—Testing. The magnetic performance of sintering Nd—Fe—B series permanent-magnet alloy is very sensitive to the sintering and tempering factors. The magnetic performance of alloys with the same components can vary greatly from several times to tens of times or even to hundreds of times depending on the different sinter and temper processes. Therefore, it is very important to understand the effects of the heat treatment temper process on magnetic performance.

The temper process of sintered Nd—Fe—B permanent magnets can include a primary or a secondary temper treatment of the sintered and cooled Nd—Fe—B permanent-magnet blank. In the primary treatment, the sintered and cooled Nd—Fe—B permanent-magnet blank is heated to the temper temperature in the heating chamber of the vacuum furnace and insulated (held therein for a desired time). Then argon, nitrogen, or another inert gas is charged to the cooling chamber of the furnace for air-quench cooling the blank. The secondary treatment follows the same process as the primary temper treatment, but after the air-quench cooling, the material is heated to the second temper temperature and held at such temperature for a desired time. Then, the argon, nitrogen, or another inert gas is charged for air-quench cooling the material again.

Temper treatment can significantly improve the magnetic performance of the Nd—Fe—B permanent magnet, especially its coercive force. Better magnetic performance can be obtained if the alloy is cooled down immediately after the temper treatment. However, current technology is limited because the argon, nitrogen, or another inert gas used in the existing temper process is under normal (or atmospheric) pressure. The pressure of a fixed-volume ideal gas at a constant-temperature is directly proportional to molar numbers of the gas (i.e., Dalton's Law). Thus, in the current technology, the molar numbers of the inert gas, as a cooling exchange carrier under normal pressure, are relatively less, the cooling speed is relatively low, the intrinsic coercive force within the magnet cannot be effectively increased, and the excellent consistency of the intrinsic coercive force cannot be reached.

SUMMARY OF THE INVENTION

The purpose of this invention is to improve existing technology and provide a new temper process of sintered Nd—Fe—B permanent-magnet material by increasing the cooling speed after tempering. This process optimizes the microstructure of the Nd—Fe—B magnet, and improves the intrinsic coercive force and consistency in the magnet.

DESCRIPTION OF THE INVENTION

The new temper process of sintered Nd—Fe—B permanent-magnet material includes temper treatments to the Nd—Fe—B permanent-magnet blank after sintering. A vacuum furnace has at least one heating chamber and at least one cooling chamber. The sintered and cooled Nd—Fe—B permanent-magnet blank is first heated to the primary temper temperature in the heating chamber of the vacuum furnace (i.e., primary heat treatment) and held at that temperature for a desired time. After such heating and insulation, the Nd—Fe—B permanent-magnet blank is sent to the cooling chamber of the vacuum furnace, which chamber is charged with argon, nitrogen, or another inert gas for air-quench cooling the blank. Then, the Nd—Fe—B permanent-magnet blank is heated to the second temper temperature in the heating chamber (secondary heat treatment) and held at such temperature for a desired time. Then, the blank is sent to the cooling chamber, which is charged with argon, nitrogen, or another inert gas for air-quench cooling such blank again. The new feature of the temper process in the present invention is that after a temper and insulation at the temper temperature, the blank is immediately sent to the cooling chamber and immersed in a vessel filled with a liquid at normal or ambient temperature. At the same time, the vacuum furnace is charged with pressurized argon, nitrogen, or another inert gas. The pressure is 1.8 to 3.5 times higher than the existing normal (atmospheric) pressure of the gas used. A ventilation fan is immediately started to circulate the gas for quick cooling.

The temperature of the primary temper treatment is between about 900° C. and 930° C. and the insulation or heating time preferably is from about 2 to 3 hours. The temperature of the secondary temper treatment is between about 500° C. and 630° C., and the insulation or heating time preferably is from about 2 to 4.5 hours. With these temper temperatures, followed by cooling in the cooling chamber according to the invention, as a result, the rate of cooling speed is between about 80° C. and 120° C. per minute.

The tempering liquid can be oil or water.

This invention increases the cooling speed after the Nd—Fe—B permanent magnet is sintered. The crystalline grain boundary structure of the magnet is optimized, which eventually improves the intrinsic coercive force and its consistency.

The heating and cooling treatments result in an unbalanced eutectic reaction because of the uneven and unclear interphase between the rich Nd phase layer of the boundary central area and the epitaxial layer. The anti-magnetization domain core is created because of the lower isomerism field of the epitaxial-layer directions and the higher scattered magnetic field around the interphase. Therefore, the intrinsic coercive force of the sintered magnet is relatively lower.

To improve the intrinsic coercive force, the primary and secondary temper processes can be used to harden the epitaxial layer of the main-phase crystalline grain. When carrying out the primary and secondary temper processes, the Nd, O and C atoms of the main-phase crystalline grain epitaxial layer diffuse toward the rich Nd phase area and the Fe and B atoms of the rich Nd phase area diffuse toward the main-phase crystalline grain. This diffusion eventually makes the component and structure of the $Nd_2Fe_{14}B$ epitaxial layer crystalline grain become the component and structure of the $Nd_2Fe_{14}B$ phase. Then the interphase becomes straight and smooth with all-direction isomerism fields, resulting in a decreased scattered magnetic field and improved coercive force.

Using the lower cooling speed of the existing tempering technology cannot guarantee the consistency of the crystal boundary components of the magnetic material under insulation. As a result, the scattered magnetic field cannot be fully lowered and the intrinsic coercive force cannot be fully improved. Compared to the existing technology, the cooling method adopted by this invention greatly increases the cooling speed, which eventually solidifies the crystal boundary components within a very short time, improves the appearance of the crystal boundary, optimizes the boundary components, guarantees the straightness and smoothness of the interphase, lowers the scattered magnetic field, and increases the intrinsic coercive force and its consistency.

EXPERIMENTS

Experiment 1

Temper experiments on the sintered Nd—Fe—B magnet with the same alloy components were carried out. After the Nd—Fe—B magnet was sintered and cooled down, the first half of the sintered and cooled Nd—Fe—B magnet blank was treated with the existing primary and secondary temper treatments as follows:

The sintered and cooled Nd—Fe—B permanent-magnet blank was heated to the primary temper temperature in the heating chamber of the vacuum furnace. After the insulation at that temperature, the blank was sent to the cooling chamber of the vacuum furnace, which was charged with argon, nitrogen, or another inert gas for air-quench cooling under normal or atmospheric pressure. Then, the sintered and cooled Nd—Fe—B magnet blank was sent to the heating chamber and heated to the secondary temper temperature. After the insulation at that temperature, the blank was sent to the cooling chamber, which was charged with argon, nitrogen, or another inert gas for air-quench cooling the blank again under normal or atmospheric pressure.

The second half of the blank was cooled in accordance with the inventive process as follows:

The sintered and cooled Nd—Fe—B permanent-magnet blank was heated in the heating chamber of the vacuum furnace to the same primary and secondary temper temperatures as those used for the first half. After insulation at those temperatures, the Nd—Fe—B permanent magnet blank was immediately sent to the cooling chamber of the vacuum furnace and immersed into the vessel filled with a normal (room) temperature liquid. At the same time, the vacuum furnace was charged with argon, nitrogen, or another inert gas (the pressure was about 1.8 to 3.5 times higher than the existing normal pressure of the gas) as a cooling exchange carrier. Then a ventilation motor was immediately started to circulate the pressurized gas for quick cooling of the blank in the cooling chamber.

The first temperature of the temper treatment was about 900° C.; the insulation time was about 2 hours; the second temperature was about 500° C. and the insulation time was about 2 hours. The stated cooling speed was at about 80° C. per minute.

Experiment 2

Temper experiments on the sintered Nd—Fe—B magnet with the same alloy components were carried out. After the Nd—Fe—B magnet was sintered and cooled down, the first half of the sintered and cooled Nd—Fe—B magnet blank was treated with the existing primary and secondary temper treatments as follows:

The sintered and cooled Nd—Fe—B permanent-magnet blank was heated to the primary temper temperature in the heating chamber of the vacuum furnace and after the insulation at that temperature, the blank was sent to the cooling chamber of the vacuum furnace charged with argon, nitrogen, or another inert gas for air-quench cooling under normal or atmospheric pressure. Then, the sintered and cooled blank was sent to the heating chamber and heated to the secondary temper temperature. After insulation at that temperature, the blank was sent to the cooling chamber, which was charged with argon, nitrogen, or another inert gas for air-quench cooling the blank again under normal or atmospheric pressure.

The second half of the blank was cooled in accordance with the inventive process as follows:

The sintered and cooled blank was heated to the same primary and secondary temper temperatures as those used for the first half. After the temper and insulation at those temperatures, the magnet blank was immediately sent to the cooling chamber of the vacuum furnace and immersed into the vessel filled with a normal (room) temperature liquid. At the same time, the vacuum furnace was charged with argon, nitrogen, or another inert gas (the pressure was about 1.8 to 3.5 times higher than the existing normal pressure of the inert gases) as a cooling exchange carrier. Then, a ventilation motor was immediately started to circulate the pressurized gas for quick cooling of the blank in the cooling chamber.

The stated primary temperature of the temper treatment was about 930° C., the insulation time was about 3 hours; the secondary temperature of the temper treatment was about 630° C. and the insulation time was about 4.5 hours.

The stated cooling speed was about 120° C. per minute.

Experiments 1 and 2 separately tested two products—low coercive force and high coercive force materials. Both products were tested using existing technology and the invented process.

See Tables 1 and 2 for the test data of Experiment 1 and Tables 3 and 4 for the test data of Experiment 2.

TABLE 1

Magnetic Performance Test Result Under the Existing Cooling Process After Temper

| No. | Br (KGs) | Hci (Koe) | (BH)max (MGOe) |
|---|---|---|---|
| 1 | 13.01 | 12.79 | 41.48 |
| 2 | 12.96 | 12.87 | 41.00 |
| 3 | 12.96 | 12.93 | 41.24 |
| 4 | 12.99 | 12.62 | 41.27 |
| 5 | 13.00 | 13.02 | 41.42 |
| 6 | 13.08 | 12.88 | 41.54 |
| 7 | 13.06 | 12.91 | 41.42 |
| 8 | 13.06 | 12.66 | 41.19 |
| 9 | 12.98 | 13.05 | 41.00 |
| 10 | 12.99 | 12.95 | 41.08 |

Abbreviations:
Br means the remanente magnetic induction.
Hci means the intrinsic coercive force.
(BH)max means the maximum magnetic energy product.

TABLE 2

Magnetic Performance Test Results After Increasing the Cooling Speed and Temper

| No. | Br (KGs) | Hci (Koe) | (BH)max (MGOe) |
|---|---|---|---|
| 1 | 12.99 | 14.14 | 41.02 |
| 2 | 12.97 | 14.17 | 40.95 |
| 3 | 13.02 | 14.16 | 41.12 |
| 4 | 12.95 | 14.22 | 40.90 |
| 5 | 12.97 | 14.25 | 40.98 |
| 6 | 13.09 | 14.20 | 41.52 |
| 7 | 13.03 | 14.22 | 41.31 |
| 8 | 12.97 | 14.33 | 41.08 |
| 9 | 12.99 | 14.17 | 40.99 |
| 10 | 13.05 | 14.18 | 41.42 |

TABLE 3

Magnetic Performance Test Results Under the Existing Cooling Process After Temper

| No. | Br (KGs) | Hci (Koe) | (BH)max (MGOe) |
|---|---|---|---|
| 1 | 12.42 | 20.66 | 37.8 |
| 2 | 12.44 | 20.62 | 37.93 |
| 3 | 12.38 | 20.79 | 37.51 |
| 4 | 12.46 | 20.48 | 37.93 |
| 5 | 12.46 | 20.60 | 38.12 |
| 6 | 12.39 | 20.53 | 37.81 |
| 7 | 12.41 | 20.77 | 37.38 |
| 8 | 12.48 | 20.82 | 38.17 |
| 9 | 12.41 | 20.88 | 38.5 |
| 10 | 12.40 | 20.36 | 37.57 |

TABLE 4

Magnetic Performance Test Results After Increasing the Cooling Speed and Temper

| No. | Br (KGs) | Hci (Koe) | (BH)max (MGOe) |
|---|---|---|---|
| 1 | 12.39 | 22.32 | 37.66 |
| 2 | 12.39 | 22.47 | 37.60 |
| 3 | 12.45 | 22.38 | 38.15 |
| 4 | 12.48 | 22.51 | 38.21 |
| 5 | 12.40 | 22.53 | 37.81 |
| 6 | 12.44 | 22.46 | 37.74 |
| 7 | 12.43 | 22.42 | 37.86 |
| 8 | 12.43 | 22.43 | 37.64 |
| 9 | 12.41 | 22.50 | 37.62 |
| 10 | 12.46 | 22.39 | 37.84 |

The test results of Experiment 1 showed that after increasing the temper cooling speed the average increase of the intrinsic coercive force is 1.336 KOe and the range value was reduced from 0.403 KOe to 0. 19 KOe.

The test results of Experiment 2 showed that after increasing the temper cooling speed the average increase of the intrinsic coercive force is 1.790 KOe and the range value was reduced from 0.520 KOe to 0.21 KOe.

The experiments have indicated that this invention can greatly improve the consistency and intrinsic coercive force within the Nd—Fe—B magnet.

The invention claimed is:

1. A temper method for a Nd—Fe—B permanent magnet, comprising (a) heating the magnet in a primary temper process to a primary temper temperature;

(b) cooling the magnet in the primary temper process in a cooling liquid in a chamber into which a pressurized cooling exchange gas under a pressure of about 1.8-3.5 times higher than the normal pressure of the cooling gas is introduced;

(c) re-heating the magnet in a secondary temper process to a secondary temper temperature; and (d) cooling the magnet in the secondary temper process in a cooling liquid in a chamber into which a pressurized cooling gas under a pressure of about 1.8-3.5 times higher than the normal pressure of the cooling gas is introduced.

2. The method as in claim 1, wherein the primary temper temperature is in the range of about 900-930° C. and the secondary temper temperature is in the range of about 500-630° C.

3. The method as in claim 2, wherein the magnet is held at the primary temper temperature for about 2-3 hours before cooling and the magnet is held at the secondary temper temperature for about 2-4.5 hours before cooling.

4. The method as in claim 1, wherein the cooling liquid is water or oil.

5. The method as in claim 1, wherein the cooling gas is an inert gas.

6. The method as in claim 1, wherein the cooling gas is argon or nitrogen.

7. The method as in claim 1, wherein the magnet is cooled at a rate of about 80-120° C. per minute in the primary temper process or the secondary temper process.

8. The method as in claim 1, wherein the pressurized cooling gas is circulated in the chamber during the primary and secondary temper processes.

9. The method as in claim 8, wherein the pressurized cooling gas is circulated using a ventilation motor.

10. A temper method for a Nd—Fe—B permanent magnet, comprising (a) heating the magnet in a primary temper process to a primary temper temperature, wherein the primary temper temperature is in the range of about 900-930° C. and is held for about 2-3 hours;

(b) cooling the magnet in the primary temper process in a cooling liquid in a chamber into which a pressurized cooling exchange gas under a pressure of about 1.8-3.5 times higher than the normal pressure of the cooling gas is introduced, wherein the magnet is cooled at a rate of about 80-120° C. per minute;

(c) re-heating the magnet in a secondary temper process to a secondary temper temperature, wherein the secondary temper temperature is in the range of about 500-630° C. and is held for about 2-4.5 hours; and (d) cooling the magnet in the secondary temper process in a cooling liquid in a chamber into which a pressurized cooling gas under a pressure of about 1.8-3.5 times higher than the normal pressure of the cooling gas is introduced, wherein the magnet is cooled at a rate of about 80-120°C. per minute.

11. The method as in claim 10, wherein the cooling liquid is water or oil.

12. The method as in claim 10, wherein the cooling gas is an inert gas.

13. The method as in claim 10, wherein the cooling gas is argon or nitrogen.

14. The method as in claim 10, wherein the pressurized cooling gas is circulated in the chamber during the primary and secondary temper processes using a ventilation motor.

* * * * *